US007959742B2

(12) United States Patent
Cordill et al.

(10) Patent No.: US 7,959,742 B2
(45) Date of Patent: Jun. 14, 2011

(54) OUTER SUPPORT BODY FOR A DRAWER-TYPE DISHWASHER

(75) Inventors: Rexford W. Cordill, Granger, IN (US); Robert A. Elick, Jackson, TN (US); Kory A. Gunnerson, Lebanon, NH (US); Mark E. Palm, Davie, FL (US); John R. Sanderson, Oakland Park, FL (US); Michael C. Simmons, Moscow, TN (US); Jeff B. Thompson, Simpsonville, SC (US); Rodney M. Welch, Beach Bluff, TN (US); Thomas J. Wuestefeld, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1006 days.

(21) Appl. No.: 11/822,939

(22) Filed: Jul. 11, 2007

(65) Prior Publication Data

US 2009/0015119 A1 Jan. 15, 2009

(51) Int. Cl.
*A47B 77/06* (2006.01)
*B08B 3/02* (2006.01)

(52) U.S. Cl. ..... 134/25.2; 134/56 D; 134/200; 312/228.1

(58) Field of Classification Search ..... 134/56 D, 134/57 D, 58 D, 25.2, 200; 312/228.1
See application file for complete search history.

(56) References Cited

U.S. PATENT DOCUMENTS

| | | | | |
|---|---|---|---|---|
| 3,096,781 | A | 7/1963 | Roidt | |
| 3,304,950 | A | 2/1967 | Hubert | |
| 3,804,483 | A * | 4/1974 | Afful et al. | 312/228.1 |
| 3,826,553 | A * | 7/1974 | Cushing et al. | 312/351.3 |
| 4,243,197 | A | 1/1981 | Wright | |
| 4,889,155 | A | 12/1989 | Trotter, Sr. | |
| 4,903,723 | A | 2/1990 | Sublett | |
| 5,224,508 | A | 7/1993 | Bates, Jr. | |
| D358,404 | S | 5/1995 | Andrews | |
| 5,452,739 | A | 9/1995 | Mustee et al. | |
| D388,566 | S | 12/1997 | Reid et al. | |
| 5,755,244 | A | 5/1998 | Sargeant et al. | |
| 5,883,300 | A | 3/1999 | Johnson | |
| 5,992,954 | A | 11/1999 | Becker | |
| 6,244,277 | B1 * | 6/2001 | Maunsell | 134/60 |
| 6,398,495 | B1 | 6/2002 | Kazianus | |
| 6,447,081 | B1 | 9/2002 | Sargeant et al. | |
| 6,460,555 | B1 | 10/2002 | Tuller et al. | |

(Continued)

FOREIGN PATENT DOCUMENTS

JP 2002315710 10/2002

*Primary Examiner* — Joseph L Perrin
*Assistant Examiner* — Benjamin Osterhout
(74) *Attorney, Agent, or Firm* — Robert A. Bacon; Diederiks & Whitelaw PLC

(57) ABSTRACT

An outer support body for a drawer-type dishwasher includes first and second U-shaped brackets. The first U-shaped bracket includes first and second leg members that are joined by a first cross member. Likewise, the second U-shaped bracket includes third and fourth leg members that are joined by a second cross member. The outer support body also includes side wall members that are secured to the first and third and second and fourth leg members respectively. A rear brace extends between and interconnects the side wall members at a position spaced from the second cross member. In addition, a drip pan is provided at a bottom portion of the outer support body between the side wall members.

20 Claims, 4 Drawing Sheets

U.S. PATENT DOCUMENTS

| | | | | |
|---|---|---|---|---|
| 6,491,049 | B1 | 12/2002 | Tuller et al. | |
| 6,666,218 | B2 * | 12/2003 | Lavoie et al. | 134/25.2 |
| 6,718,993 | B1 | 4/2004 | De Martini | |
| 6,755,490 | B2 * | 6/2004 | Welch et al. | 312/228.1 |
| 6,764,147 | B2 * | 7/2004 | Flowers | 312/228 |
| 6,938,790 | B2 | 9/2005 | Hughes | |
| 7,219,678 | B2 | 5/2007 | Nakano et al. | |
| 2004/0065355 | A1 | 4/2004 | De Martini | |
| 2004/0085006 | A1 | 5/2004 | Shinchi et al. | |

* cited by examiner

OUTER SUPPORT BODY FOR A DRAWER-TYPE DISHWASHER

BACKGROUND OF THE INVENTION

1. Field of the Invention

The present invention pertains to the art of dishwashers and, more particularly, to an outer support body for a drawer-type dishwasher.

2. Discussion of the Prior Art

In general, dishwashers having pull-out drawers supported in a cabinet are known in the art. In some cases the dishwasher may include a single pull-out drawer or washing chamber while, in other cases, the dishwasher can include an upper pull-out drawer forming a first washing chamber for washing dishware and a lower pull-out drawer forming a second washing chamber which can be used to supplement the first washing chamber. In any event, the pull-out drawer(s) is typically mounted to extensible rails that are carried by or mounted to a fully enclosed cabinet. In most instances, the cabinet is positioned under a kitchen countertop adjacent cabinetry or other kitchen appliances.

Manufacturers of home appliances face a highly competitive market. Thus, there is a constant struggle to reduce both the number and complexity of various parts of appliances, as well as lower costs associated with manufacturing. All of the above must be accomplished without detracting from an established level of quality. One method found to reduce both the number of parts and manufacturing costs is to re-evaluate the design of fundamental components of the appliance.

Given that a dishwasher is placed under a kitchen countertop adjacent cabinetry, walls or other appliances, there is simply no longer an absolute need for a fully enclosed cabinet. Accordingly, manufacturers of conventional dishwashers have reduced the number or parts required to construct the cabinet. That is, manufacturers have done away with the enclosed cabinet and developed an assembly which mounts a washing tub on minimal support structure which can be readily positioned under the countertop and then secured to adjacent structure. While this solution is fine for conventional dishwashers, drawer-type dishwashers require additional structure for supporting extensible rails that slidably support one or more drawers. In addition, specific structure must be provided for raising and lowering a lid member that seals about an upper opening of the washing chamber during a washing operation. Moreover, the cabinet must be sufficiently reinforced so as to resist any racking forces that may be developed through loading and shifting of the drawers.

Based on the above, there exists a need for a low cost, easily manufactured outer body arrangement for a drawer-type dishwasher that includes specific structure for supporting a laterally movable washing chamber and a vertically shiftable lid member, while still being able to resist racking forces.

SUMMARY OF THE INVENTION

The present invention is directed to an outer support body or frame for a drawer-type dishwasher. In accordance with the invention, the outer support body includes a drip pan having front, rear and opposing side edge portions to which are attached first and second U-shaped brackets. The first U-shaped bracket is attached to the drip pan adjacent the front edge portion and includes first and second leg members that are joined by a first cross member. The second U-shaped bracket is attached to the drip pan adjacent the rear edge portion. The second U-shaped bracket includes third and fourth leg members that are joined by a second cross member.

In order to provide suitable resistance to any racking forces that may develop through operation of the dishwasher, a rear brace is mounted to the support body. Preferably, the rear brace extends between and interconnects the third and fourth leg members at a position spaced from the second cross member. More preferably, the third and fourth leg members are provided with recessed portions, spaced from the second cross member, for receiving the rear brace. That is, the rear brace includes first and second leg sections which are interconnected by an intermediate section, with each of said first and second leg sections being formed so as to nest within a respective recessed portion.

In further accordance with the invention, the outer support body includes a side wall member secured to the first and third leg members and another side wall member secured to the second and fourth leg members. The side wall members serve as mounting structure for additional components, such as drawer support brackets, as well as provide a structural benefit by establishing a shear plane.

In accordance with the most preferred form of the invention, the outer support body further includes a front brace that extends between and interconnects, so as to interlock, the first and second leg members. The front brace is arranged along the first and second leg members at a position spaced from the first cross member. Actually, the front brace is arranged at approximately a mid-point of the first and second leg members so as to define upper and lower drawer receiving portions. A separate drawer or washing chamber is slidably supported in each drawer receiving portion through respective drawer support brackets.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
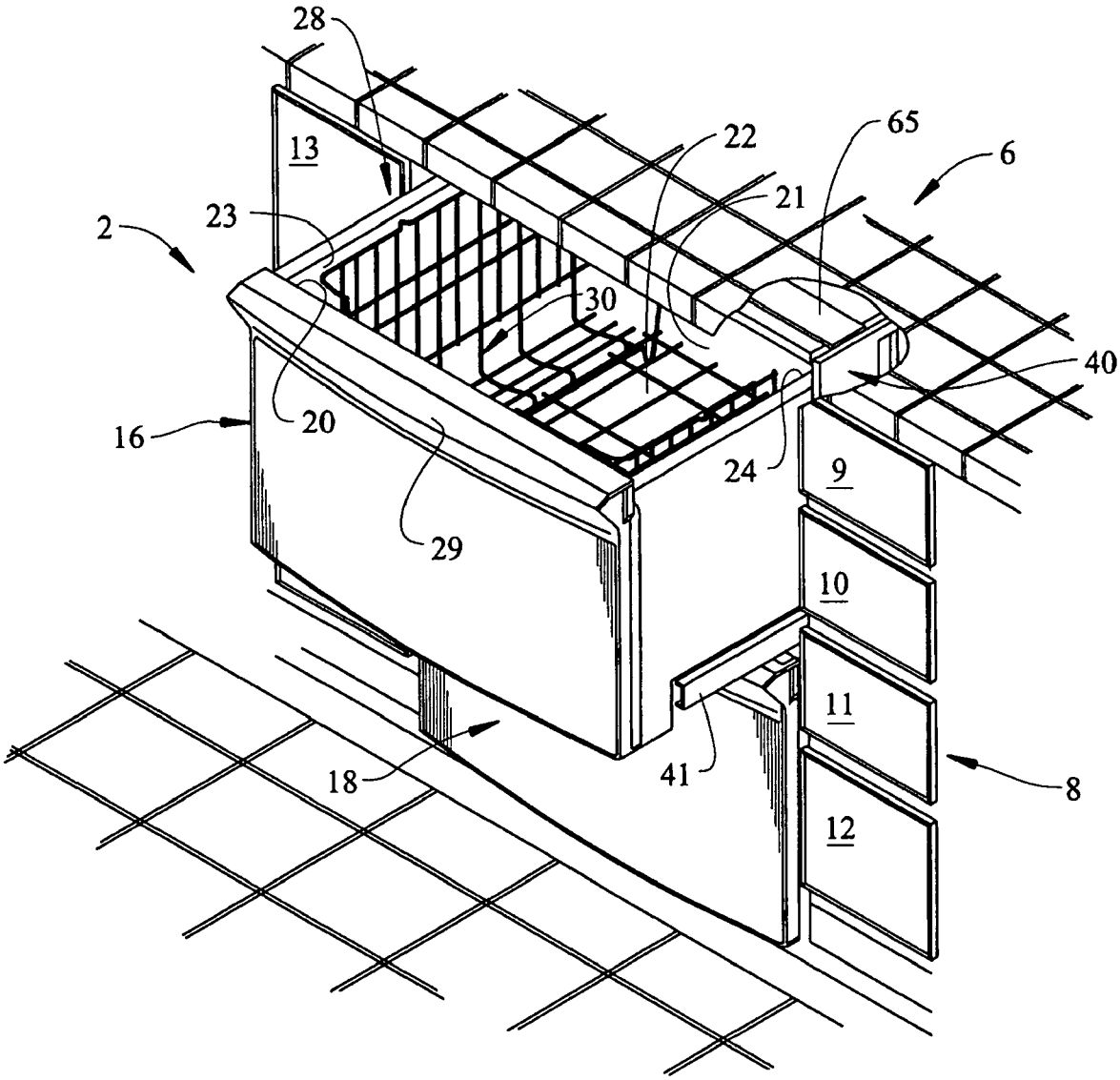
FIG. 1 is an upper right perspective view of a drawer-type dishwasher incorporating an outer support body constructed in accordance with the present invention.

With initial reference to FIG. 1, a dishwasher constructed in accordance with the present invention is generally indicated at 2. As shown, dishwasher 2 is arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher 2 having an upper washing unit or drawer 16 and a lower washing unit or drawer 18.

In accordance with the embodiment shown, upper drawer 16 includes a front wall 20, a rear wall 21, a bottom wall 22 and opposing side walls 23 and 24 that collectively define an upper wash chamber or tub 28. In a manner known in the art, upper drawer 16 is provided with a handle 29 that enables a consumer to readily access tub 28 to add or remove items to be washed. In a manner also known in the art, tub 28 includes a dishrack 30 for supporting various objects, such as glassware, utensils and the like, to be exposed to a washing operation.

As will be discussed more fully below, upper drawer 16 is slidably mounted within an outer support body 40 through a pair of extensible drawer support glides or rails, one of which is indicated at 41. In addition, upper drawer 16 is provided with a vertically shiftable lid member (not separately labeled) that is adapted to selectively seal against an upper portion (not separately labeled) of tub 28. That is, when upper drawer 16 is inserted into outer support body 40, the lid member is lowered to seal about tub 28 and, when drawer 16 is withdrawn from support body 40, the lid member is raised so as to enable drawer 16 to be readily withdrawn from outer support body 40 in order to provide unobstructed access to tub 28. However, as the particular manner in which the lid member is raised and/or lowered does not constitute part of the present invention, this aspect of dishwasher 2 will not be detailed further here. Instead, the present invention is particularly directed to the construction of outer support body 40.

Figure 2:
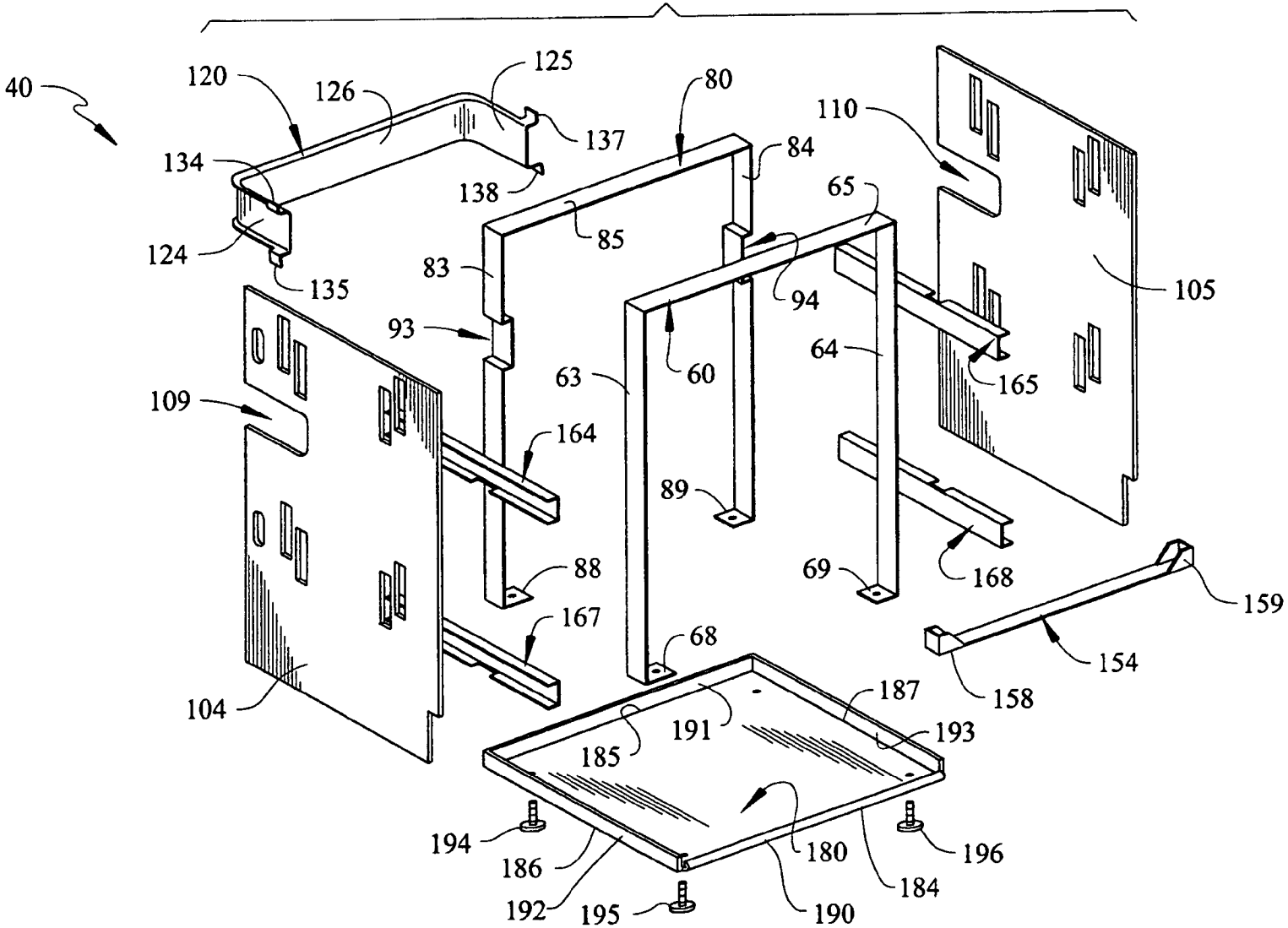
FIG. 2 is an exploded view of the outer support body constructed in accordance with a first embodiment of the present invention.
Figure 3:
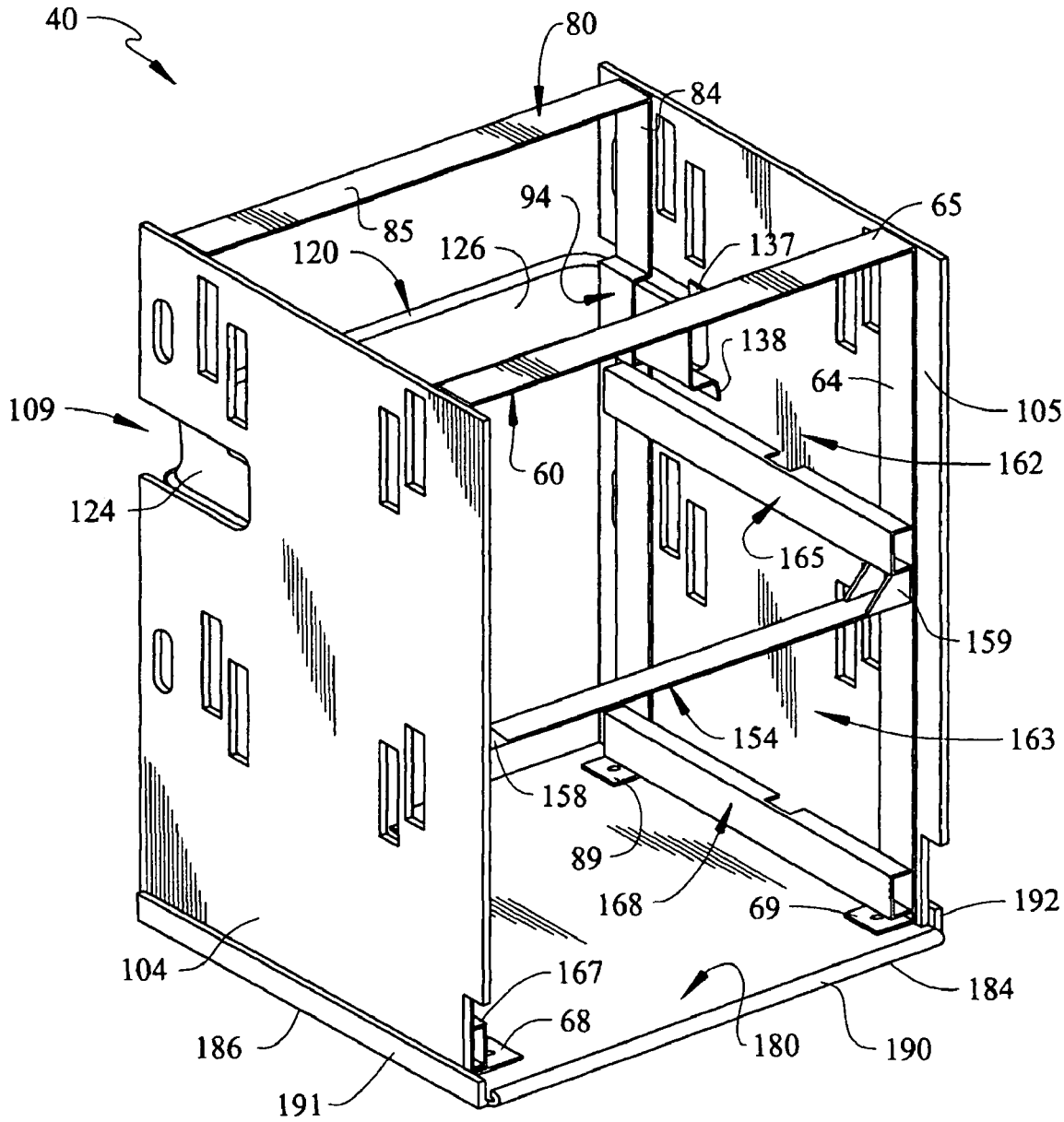
FIG. 3 is an upper left perspective view of the outer support body of FIG. 2 shown in an assembled state.

With reference to FIGS. 2 and 3 depicting a first embodiment of the invention, outer support body 40 includes a first U-shaped bracket 60 having first and second leg members 63 and 64 which are interconnected by a first cross member 65. Each leg member 63, 64 is provided with a corresponding foot member 68, 69 at a terminal end portion thereof. Support body 40 also includes a second U-shaped bracket 80 having third and fourth leg members 83 and 84 that are joined by a second cross member 85. Third and fourth leg members are provided with corresponding foot members 88 and 89. In addition, second U-shaped bracket 80 includes a pair of recessed portions 93 and 94 formed in third and fourth leg members 83 and 84 respectively. Outer support body 40 also includes a pair of opposing side wall members 104 and 105 provided adjacent first and second U-shaped brackets 60 and 80 respectively. As best shown in FIG. 2, each side wall member 104, 105 includes a corresponding notch 109, 110 which, in a manner that will be described more fully below, is arranged adjacent to a corresponding recessed portion 93, 94.

Figure 4:
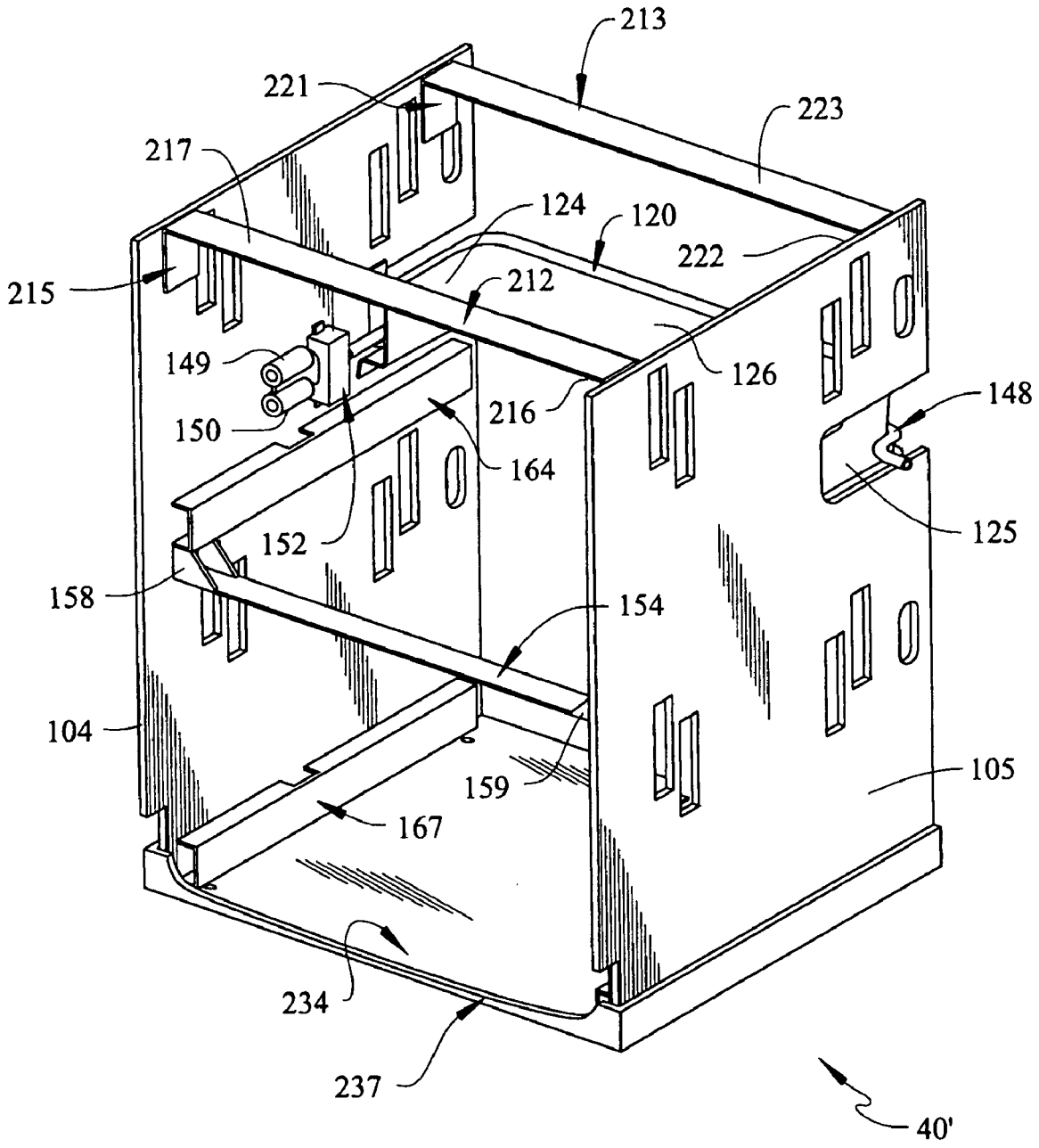
FIG. 4 is an upper right perspective view of an outer support body of a drawer-type dishwasher constructed in accordance with a second embodiment of the present invention.

In order to provide increased structural support to outer support body 40, as well as reduce the transmission of any racking forces that may be generated through operation of shifting upper and lower drawers 16 and 18, outer support body 40 includes a rear brace 120. In further accordance with the invention, rear brace 120 includes first and second leg sections 124 and 125 which are joined by an intermediate section 126. Each leg section 124, 125 terminates in a pair of mounting ears 134, 135 and 137, 138 respectively. In addition to minimizing the transmission of racking forces, rear brace 120 serves as a conduit or channel supporting, for example, utility connections for dishwasher 2. For instance, as best shown in FIG. 4, a water inlet conduit 148 runs behind intermediate section 126 and extends out from first leg section 124 prior to terminating in first and second water outlets 149 and 150. Outlets 149 and 150 are subsequently coupled to upper and lower drawers 16 and 18 respectively. Actually, first and second outlets 149 and 150 are secured to side wall member 104 through an outlet mounting member 152 which also serves to split water inlet conduit 148 into outlets 149 and 150. Of course, it should be understood that, in addition to water utilities, rear brace 120 could also serve as a support and ducting conduit for electrical utilities, as well as a drain line.

In addition to rear brace 120, additional structural support is provided by a front brace 154. Front brace 154 includes first and second end sections 158 and 159 that are respectively secured or mounted to first and second leg members 63 and 64. Preferably, front brace 154 is mounted at a midpoint of leg members 63 and 64 so as to divide outer support body 40 into upper and lower drawer receiving cavities 162 and 163. Towards that end, each drawer receiving cavity 162, 163 is provided with a pair of drawer side brackets 164, 165 and 167, 168 respectively. Drawer side brackets 164, 165 and 167, 168 provide mounting structure for extensible support glides or rails, such as rail 41 of FIG. 1.

In accordance with the most preferred form of the invention, outer support body 40 is further provided with a bottom portion or drip pan 180 having front, rear and opposing side edge portions 184-187. In accordance with one aspect of the invention illustrated in FIGS. 2 and 3, front edge portion 184 includes a hemmed lip 190. Hemmed lip 190 prevents any washing fluid that falls onto drip pan 180 from readily passing out from dishwasher 2, instead allowing the washing fluid to evaporate. In addition, rear edge portion 185 and opposing side edge portions 186 and 187 are provided with upstanding side members 191-193, with each upstanding side member 192, 193 overlapping onto a corresponding side wall member 104, 105. Of course, side wall members 104, 105 and drip pan 180 could also be formed as a single component.

Outer support body 40 is preferably formed from metal such that leg members 68, 69, 88 and 89 are secured to drip pan 180 through, for example, a welding operation. Drawer side brackets 164, 165 and 167, 168 are directly secured to leg members 63, 64, 83 and 84. As best shown in FIG. 3, rear brace 120 is mounted across a rear portion of outer support body 40, with rear brace 120 being received by recessed portions 93 and 94 and mounting ears 134, 135 and 137, 138 being secured to, side wall members 104 and 105 respectively, while side wall members 104 and 105 are also attached to U-shaped brackets 60 and 80. In this manner, rear brace 120 extends between and interlocks side wall members 104, 105. Once assembled, a plurality of leveling legs, three of which are indicated at 194-196, with a fourth leveling leg not being shown, are passed through respective openings (not separately labeled) formed in drip pan 180 and then threadedly connected to leg members 68, 69 and 88, 89 such that leveling legs 194-196 may be adjusted to ensure that dishwasher 2 is properly positioned under, for example, countertop 6. Although not shown, it should be readily understood that a fourth leveling leg is also positioned on drip pan 180. At this point, it should be understood that, while described as being joined by welding, various other metal-to-metal joining techniques, including the use of mechanical fasteners, can be employed. It should also be understood that in the place of metal, outer support body 40 could be constructed in all or in part from other materials, such as plastic, wherein the various components would be joined through, for example, sonic welding, adhesive, mechanical fasteners or other known joining techniques.

In accordance with another embodiment of the present invention illustrated in FIG. 4 wherein like reference numbers represent correspondingly constructed parts in the respective views, a dishwasher frame 40' is shown to include first and second U-shaped brackets 212 and 213 secured to side wall members 104 and 105 respectively. More specifically, first U-shaped bracket 212 includes first and second shortened leg members 215 and 216 which are joined by a first cross member 217, while second U-shaped member 213 includes corresponding third and fourth shortened leg members 221 and 222 joined by a second cross member 223. Shortened leg members 215, 216, 221 and 222 are directly secured to an upper portion of side wall members 104 and 105 respectively. Likewise, rear brace 120 is directly secured to and thus interlocks side wall members 104 and 105 through mounting ears 134, 135, 137 and 138. Outer support body 40' also includes a drip pan 234 having a front fillet member 237 which extends along a front edge portion (not separately labeled) of outer support body 40'. Front fillet member 237 provides added structural support to outer support body 40'. Front fillet member 237 also prevents any washing fluid which may escape from upper and lower drawers 16 and 18 from readily egressing from dishwasher 2. Still further structural stability could be provided by, for example, securing the front fillet to a toe kick portion (not labeled) of cabinetry 8.

Although described with reference to a preferred embodiment of the invention, it should be readily understood that various changes and/or modifications can be made to the invention without departing from the spirit thereof. For instance, while the outer support body is illustrated in connection with a multi-compartment dishwasher, it should be noted that the support body could also be employed in connection with a single compartment unit. Also, it should be understood that the drip pan could take on various forms, including being provided as a separate component upon which the dishwasher could rest. In general, the invention is only intended to be limited by the scope of the following claims.

We claim:

1. A dishwasher comprising:

a drawer defining a washing chamber;

a lid positioned above the drawer for selectively sealing the washing, chamber during a washing operation; and an outer support body for supporting both the drawer and the lid, therein, said outer support body including;

a first U-shaped bracket including first and second leg members joined by a first cross member;

a second U-shaped bracket including third and fourth leg members joined by a second cross member;

a first side wall member secured to the first and third leg members;

a second side wall member secured to the second and fourth leg members; and a rear brace extending between and interlocking the first and second side wall members at a position spaced from the second cross member, said rear brace providing resistance to racking forces transferred to the outer support body by the drawer.

2. The dishwasher according to claim 1, wherein each of the third and fourth leg members includes a recessed portion at a position spaced from the second cross member.

3. The dishwasher according to claim 2, wherein the rear brace includes first and second leg sections interconnected by an intermediate section, each of said first and second leg sections nesting within a respective recessed portion.

4. The dishwasher according to claim 1, further comprising: a utility conduit extending between the first side wall member and the rear brace.

5. The dishwasher according to claim 1, wherein the outer support body further includes first and second drawer side brackets for slidably supporting the drawer.

6. The dishwasher according to claim 5, wherein, the first drawer side bracket is mounted to the first and third leg members and the second drawer side bracket is mounted to the second and fourth leg members.

7. The dishwasher according to claim 1, wherein the outer support body further includes a front brace extending between and interconnecting the first and second leg members, said front brace being spaced from the first cross member so as to define upper and lower drawer receiving portions.

8. The dishwasher according to claim 7, wherein the front brace is arranged at approximately a mid-point of the first and second leg members.

9. The dishwasher according to claim 7, wherein the outer support body includes first and second pairs of drawer side brackets, said first pair of drawer side brackets being arranged in the upper drawer receiving portion and said second pair of drawer side brackets being arranged in the lower drawer receiving portion.

10. The dishwasher according to claim 9, further comprising: another drawer defining another washing chamber, said drawer being slidably supported by the first pair of drawer support brackets and said another drawer being slidably supported by the second pair of drawer support brackets.

11. The dishwasher according to claim 1, wherein the outer support body further includes a bottom portion extending between and interconnecting the first and second side wall members.

12. The dishwasher according to claim 11, wherein the bottom portion constitutes a drip pan having front, rear and opposing side edge portions and wherein the drip pan includes first and second side members and a rear member that extend upward from the opposing side edge portions and rear edge portion respectively.

13. The dishwasher according to claim 12, wherein each of the first and second U-shaped brackets includes a pair of foot members provided at terminal end portions thereof, said drip pan being secured to the foot members.

14. The dishwasher according to claim 13, wherein the drip pan included a hemmed lip provided at the front edge portion.

15. The dishwasher according to claim 13, wherein the drip pan includes a front fillet member provided at the front edge portion.

16. A method of assembling an outer support body for slidably supporting therein a drawer defining a washing chamber of a dishwasher comprising:

interconnecting opposing side wall members with front and rear U-shaped brackets; and connecting a rear brace to the opposing side wall members to interlock the first and second side wall members so as to cause the rear brace to provide resistance to racking forces transferred to the outer support body by the drawer.

17. The method of claim 16, further comprising: routing a conduit between one of the opposing side wall members and the rear brace.

18. The method of claim 16, further comprising: securing a drip pan between the opposing side wall members, said drip pan establishing a bottom portion of the outer support body.

19. The method of claim 16, further comprising: positioning the rear brace in recessed portions formed in the rear U-shaped bracket.

20. A dishwasher comprising:

a drawer defining a washing chamber;

a lid positioned above the drawer for selectively sealing the washing chamber during a washing operation; and an outer support body for supporting both the drawer and the lid therein, said outer support body including;

a first U-shaped bracket including first and second leg members joined by a first cross member;

a second U-shaped bracket including third and fourth leg members joined by a second cross member;

a first side wall member secured to the first and third leg members;

a second side wall member secured to the second and fourth leg members, the first and second side wall members defining a cavity in which the drawer is supported; and a rear brace extending between and interlocking the first and second side wall members at a position spaced from the second cross member, said rear brace providing resistance to racking forces transferred to the outer support body by the drawer.

* * * * *

UNITED STATES PATENT AND TRADEMARK OFFICE

CERTIFICATE OF CORRECTION

PATENT NO. : 7,959,742 B2
APPLICATION NO. : 11/822939
DATED : June 14, 2011
INVENTOR(S) : Rexford W. Cordill et al.

It is certified that error appears in the above-identified patent and that said Letters Patent is hereby corrected as shown below:

Col. 5, lines 27-45, Claim 1: "A dishwasher comprising: a drawer defining a washing chamber; a lid positioned above the drawer for selectively sealing the washing, chamber during a washing operation; and an outer support body for supporting both the drawer and the lid,therein, said outer support body including; a first U-shaped bracket including first and second leg members joined by a first cross member; a second U-shaped bracket including third and fourth leg members joined by a second cross member; a first side wall member secured to the first and third leg members; a second side wall member secured to the second and fourth leg members; and a rear brace extending between and interlocking the first and second side wall members at a position spaced from the second cross member, said rear brace providing resistance to racking forces transferred to the outer support body by the drawer." - should be Claim 1: --A dishwasher comprising: a drawer defining a washing chamber; a lid positioned above the drawer for selectively sealing the washing chamber during a washing operation; and an outer support body for supporting both the drawer and the lid therein, said outer support body including; a first U-shaped bracket including first and second leg members joined by a first cross member; a second U-shaped bracket including third and fourth leg members joined by a second cross member; a first side wall member secured to the first and third leg members; a second side wall member secured to the second and fourth leg members; and a rear brace extending between and interlocking the first and second side wall members at a position spaced from the second cross member, said rear brace providing resistance to racking forces transferred to the outer support body by the drawer.--

Col. 5, lines 59-62, Claim 6: "The dishwasher according to claim 5, wherein, the first drawer side bracket is mounted to the first and third leg members and the second drawer side bracket is mounted to the second and fourth leg members." - should be Claim 6: --The dishwasher according to claim 5, wherein the first drawer side bracket is mounted to the first and third leg members and the second drawer side bracket is mounted to the second and fourth leg members.--

Signed and Sealed this
Fourteenth Day of August, 2012

David J. Kappos

David J. Kappos
*Director of the United States Patent and Trademark Office*